United States Patent [19]

DeGooyer

[11] Patent Number: 4,590,731

[45] Date of Patent: May 27, 1986

[54] TILE REINFORCING GRID

[76] Inventor: Lonnie C. DeGooyer, 349 E. 5600 S., Murray, Utah 84107

[21] Appl. No.: 521,937

[22] Filed: Aug. 10, 1983

[51] Int. Cl.[4] ..... E04C 1/10

[52] U.S. Cl. ..... 52/581; 52/388; 52/660

[58] Field of Search ..... 52/660, 581, 386, 388, 52/384; 404/36, 35, 134

[56] References Cited

U.S. PATENT DOCUMENTS

| | | | |
|---|---|---|---|
| 320,567 | 6/1885 | Lord | 52/388 |
| 1,809,870 | 6/1931 | Smith | 404/135 |
| 2,899,775 | 8/1959 | Partin | 404/36 |
| 3,802,144 | 4/1974 | Spica | 404/36 |
| 3,909,996 | 10/1975 | Ettlinger | 404/36 |
| 3,960,375 | 6/1976 | Bibi-Roubi | 404/35 |
| 4,008,548 | 2/1977 | Leclerc | 52/581 |
| 4,167,599 | 9/1979 | Nissinen | 404/41 |
| 4,168,924 | 9/1979 | Draper | 52/581 |
| 4,454,698 | 6/1984 | Manzelli | 52/581 |
| 4,468,910 | 9/1984 | Morrison | 404/36 |

FOREIGN PATENT DOCUMENTS

| | | | |
|---|---|---|---|
| 382970 | 12/1964 | Switzerland | 52/384 |

*Primary Examiner*—Henry E. Raduazo

*Attorney, Agent, or Firm*—Thorpe, North & Western

[57] ABSTRACT

A modular reinforcing grid for reinforcing and supporting a bed of mortar on a supporting surface. The grid is made up of thin strips positioned on edge and arranged to define openings of geometric shape. Mounting posts form junctions between adjacent strips to provide uniform depth to the grid. The exposed edges of the strips and the upper surfaces of the mounting posts lie in approximately the same plane to provide a grid for floating the mortar to a uniform depth. The grid is molded in uniform sizes and shapes with interlocking edges to provide continuous reinforcement and support for the mortar bed.

8 Claims, 4 Drawing Figures

TILE REINFORCING GRID

BACKGROUND

The present invention relates to a reinforcing grid to support and level mortar used in setting tile.

In setting tile on a wall or floor a layer of mortar is applied to the supporting surface and the individual tiles then adhered to the mortar. In the conventional process, a reinforcing structure, such as metal lath or expanded metal, is attached to the supporting surface by nails or screws such that the entire surface to be tiled is covered. Mortar is then applied to the entire surface and trowelled into the reinforcing structure. Redwood strips approximately ⅜ inch thick are then worked or floated into the mortar at intervals across the surface. The mortar is then leveled to a uniform depth by means of a screed which rests on the strips and smooths the mortar to a depth equal to the thickness of the strips. The strips are removed and mortar trowelled into the recesses left by the strips. The mortar is then allowed to set up before the tiles are set in place on it.

In the conventional process the mortar is reinforced and, when applied to a wall, supported by the metal lath or expanded metal immediately adjacent the supporting surface. The exposed surface of the mortar protrudes beyond the reinforcing structure and in the case of a wall, due to the effect of gravity, may tend to slump or sag. Thus, the consistency of the mortar must be carefully controlled or the mortar surface will have to be smoothed with a trowel after the mortar is floated with the screed and before the tiles are set. If the mortar is loose and the surface slumps after it is floated, it is a time-consuming and painstaking process to smooth the surface, so that it is completely flat when the tiles are set in place.

A further disadvantage of the conventional method is that the mortar must be allowed to set up and become stiff enough to support the tiles. Since the individual tiles must be positioned and then pressed against the mortar to insure an adequate bond, the mortar must be stiff enough to stay in place under the pressure of the tile. If the mortar has not been allowed to set up enough, it will be displaced by the pressure and extruded around the edges.

When tiles are set in a floor, a scaffold of boards must be erected over the mortar to allow the tile setter to gain access to the mortar surface without displacing it with his own weight. As the work progresses, the scaffolding must be shifted and the mortar smoothed where ever the boards have contacted it.

SUMMARY OF THE INVENTION

In the present invention, a reinforcing grid is provided for attachment to a supporting surface as reinforcement for a bed of mortar. The grid provides support for the exposed face of the mortar bed and also serves as a guide for floating the mortar to a uniform depth. The grid is a modular construction of molded plastic which includes at least one series of thin strips arranged on edge, the strips intersecting adjacent strips and defining geometric-shaped openings. Short posts form junctions between the adjacent strips to support the structure and space the strips from the supporting surface. The grid is molded in panels of uniform sizes and shapes with interlocking edges to provide continuous reinforcements and support for the mortar bed.

BRIEF DESCRIPTION OF THE DRAWINGS

Other objects and features of the present invention will be apparent to those skilled in the art from the following detailed description taken in combination with the attached drawings, in which.

DETAILED DESCRIPTION OF PREFERRED EMBODIMENTS

Figure 1:
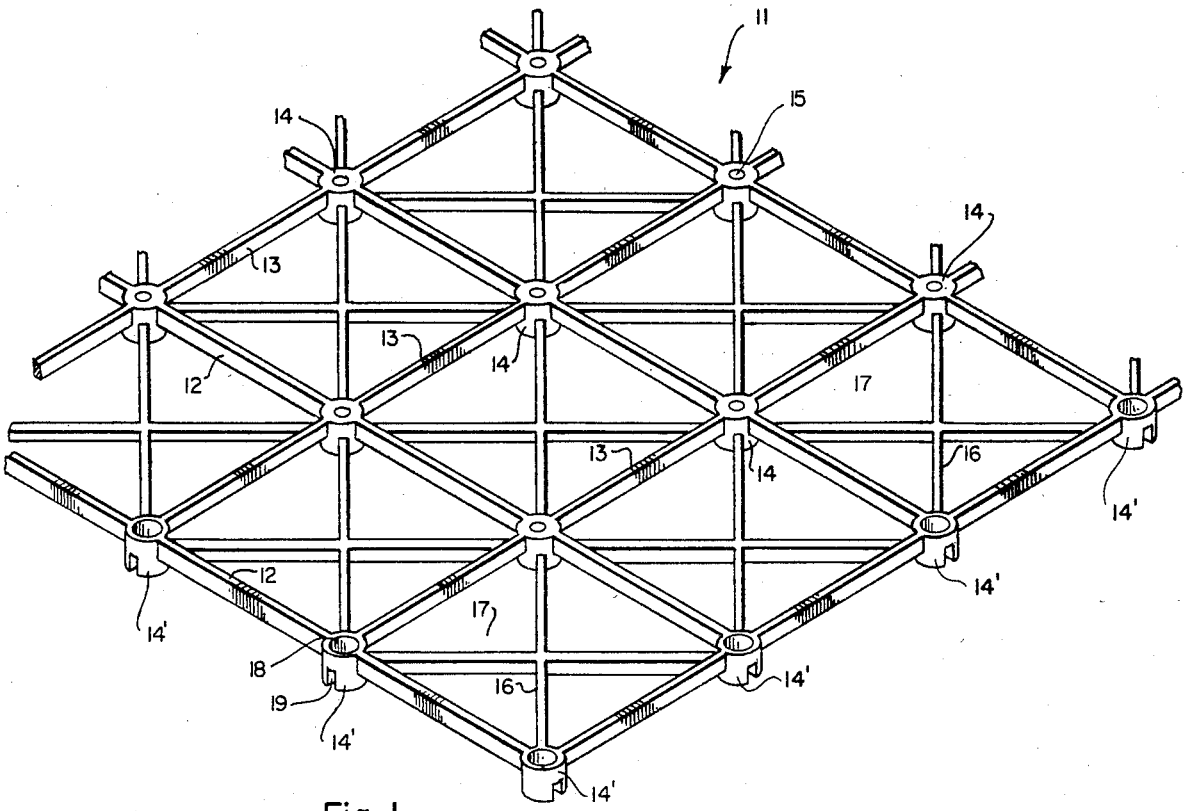
FIG. 1 is a perspective view of a reinforcing grid according to the present invention.

The disadvantages and deficiencies of the prior known processes and materials for setting tile are overcome in the present invention by provision of a reinforcing grid which avoids the use of float strips and allows the tile to be set as soon as the mortar is floated without waiting for the mortar to set up. As shown in FIG. 1, the grid 11 includes a first series of primary strips 12 positioned in generally parallel relation and spaced approximately 2 inches apart. A second series of primary strips 13 is positioned normal to the strips of the first series and intersects therewith. The strips 13 are also generally parallel with each other and spaced approximately 2 inches apart. The strips 12 and 13 are thin and are positioned with a narrow edge uppermost. A short post 14 with a countersunk upper surface is formed at each intersection between the strips 12 and the strips 13. The posts 14 are of uniform length and are formed integral with the strips 12 and 13 with the upper edges of the strips in approximately the same plane as the upper surfaces of the posts. The flat upper surface of the grid thus formed provides a smooth guide for floating the mortar to a constant depth. A central opening 15 extends axially of each post to receive a nail or screw for attachment to a supporting surface. The first and second series of primary strips define a grid or grating having generally square openings and which is supported on the posts. The grid is approximately 7/16 inch thick and is formed in modules of any desired size, but preferably 16 inches square, in an injection molding machine. Secondary series of strips 6 and 17 extend between posts along diagonals of the openings and intersect at the approximate midpoint of each opening. A hole may be provided at such intersection for additional anchoring. When the grid is attached to a supporting surface and filled with mortar, the primary and secondary strips support and reinforce the mortar. The primary strips 12 and 13 are approximately ¼ inch wide and extend over the outer half of the posts. When the grid is filled, the mortar forms a continuous layer adjacent the supporting surface and is supported at the exposed surface by the primary strips. The secondary strips 16 and 17 are positioned below the primary strips near the supporting surface where they reinforce the mortar and maintain it within the openings in the grid.

Figure 2:
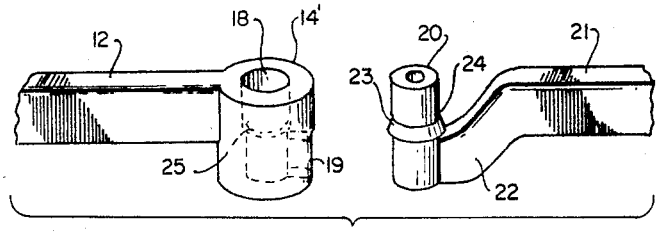
FIG. 2 is a partial view, at an enlarged scale, of an edge connector.

Connectors are formed along the edges of the grid for interconnecting adjacent modules. The posts 14' along two adjacent edges of each module are provided with an enlarged central opening 18 as shown in FIG. 2. A slot 19 is formed in the lower surface of each edge post 14' extending between the opening 18 and the periphery of the post. Slender, tubular plugs 20 are formed at the remaining two adjacent edges of each module. Each plug 20 is supported on a strip 21 which extends from the upper edge of the adjacent post and is offset vertically, as at 22, to attach to the lower edge of the plug 20. Each plug 20 is received within the enlarged central opening 18 of an edge post 14' with the strip 21 received within the slot 19. Each plug is provided with a radially extending flange 23, the upper surface of which is tapered longitudinally of the plug, as at 24. The enlarged central opening 18 of each edge post 14' is provided with a radial step 25 formed by an abrupt change in the diameter of the opening. When the plug is forced into the opening, the flange 23 bears against the step 25 and locks the plug within the edge post, thus locking the adjacent modules together. The plug and post are held in place on a supporting surface by means of a nail or screw passed through the opening in the center of the plug.

Figure 3:
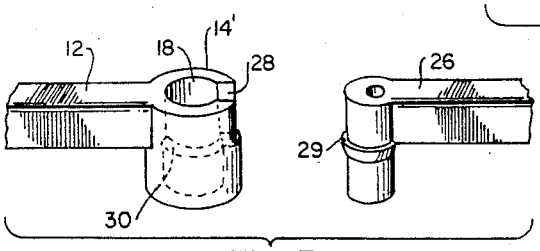
FIG. 3 is an alternative embodiment of an edge connector.

The alternative connector construction of FIG. 3 is similar to that of FIG. 2 except the strip 26 is straight and attaches to the upper edge of the tubular plug 27 and the slot 28 is formed in the upper surface of the edge post 14'. Since the plug is received in the top of the post instead of the bottom, as in FIG. 2, the radial flange 29 and the radial step 30 face in the opposite direction. It should be noted that the flange and step of either embodiment can be formed adjacent the parting line of the mold in which the grid is formed without the necessity of any laterally movable mold sections.

Figure 4:
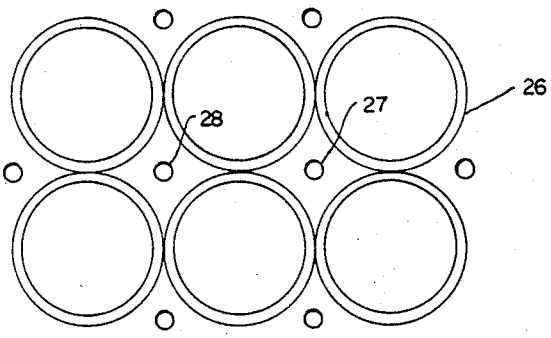
FIG. 4 is a perspective view of an alternative form of a reinforcing grid.

An alternative reinforcing grid configuration is illustrated in FIG. 4 in which a series of strips 26 is formed into circles which define circular openings. The strips are arranged in rows and intersect or are interconnected with adjacent strips to form a continuous grid. The interstices between adjacent strips and rows are left solid and form mounting posts 27 to support the grid and provide uniform depth over the entire module. The exposed edges of the strips 26 and the upper surfaces of the posts 27 are in approximately the same plane to define a level surface for the grid. Each post is provided with an axial opening 28 and the upper surface may be countersunk to receive the head of a nail or screw. The mounting posts extend beyond the lower edges of the strips so that the strips are spaced above a supporting surface. Depending upon the size of the circular openings, secondary series of strips may be provided along diameters of the openings.

While grid modules have been illustrated in FIGS. 1 and 4 with rectangular and circular openings, it is contemplated that the openings may be of any geometric shape desired as long as the strips intersect or are interconnected with each other and mounting posts are provided which form junctions between adjacent strips.

In the use of the present reinforcement grid, the supporting surface may be covered with a moisture barrier, such as tar paper or suitable plastic sheet material. A row of grid modules is interconnected on the moisture barrier and nailed to the supporting surface. The two inch spacing between the posts of each module allows placement of the grid on a wall such that some of the posts will overlie the studding and the nails or screws will be securely imbedded in the studs. Additional rows of modules are interconnected to the first row until the supporting surface is covered. In this regard, the last row and/or column of modules can be trimmed to the desired size and shape to accommodate the remaining space. After the first row is secured to the supporting surface, the additional modules are assembled one at a time by snapping the connectors together until the entire surface to be tiled is covered by the reinforcing grids. Since the edges of adjacent modules are firmly locked together, the grids form a continuous reinforcing structure over the entire surface to be tiled. After the modules are assembled, they can be secured to the supporting surface by means of nails or screws received within the plugs 20 and the openings at the intersections of the secondary strips. Mortar is then applied to and trowelled into the openings over the entire surface of the grids. The mortar is floated to the level of the grids by means of a screed resting against the exposed edges of the primary strips. The tiles can then be set in place without waiting for the mortar to set up. The 7/16 inch thickness of the grid will accommodate the inside radius of the standard cap tiles and the flexibility of the plastic strips will allow the grid to be bent or curved to conform to the contours of the supporting surface. In the case of a floor, planks can be laid directly on the mortar after it is floated to permit access by the tile setter to the mortar surface. The planks are supported by the grids and can be shifted as desired without disturbing the mortar.

The present reinforcing grid has particular application in connection with tile setting where the grid is covered with a layer of tile. However, it is contemplated that the present grid may also have application to the plastering and/or stuccoing arts where it would be covered with a finish coat of plaster or stucco.

While the invention herein described has been described by means of specific embodiments and applications thereof, numerous modifications and variations could be made thereto by those skilled in the art without departing from the spirit and scope of the present invention. It is, therefore, to be understood that within the scope of the appended claims, the invention may be practiced otherwise than as specifically described herein.

I claim:

1. A modular reinforcing structure for use in setting tile comprising:

a first and second series of primary strips arranged in intersecting relation to form a grid defining rectangular openings, mounting posts having axial openings therein at the intersections of said first and second series of primary strips to provide uniform depth to the grid, said grids and posts being formed integrally with each other with the upper edges of said primary strips being in the approximate plane of the upper surfaces of the posts and the lower edges of said primary strips at the approximate midlength of the posts; and secondary series of strips extending between posts on the diagnosis of the openings, the secondary strips intersecting at the approximate midpoints of the openings and having upper edges which lie in a plane below the upper edges of said primary strips.

2. A modular reinforcing grid as defined in claim 1 wherein connectors are provided on the edges of each grid module with similar connectors on adjacent edges.

3. A modular reinforcing grid as defined in claim 2 wherein male connectors are provided on two adjacent edges and female connectors are provided on the remaining two adjacent edges.

4. A modular reinforcing grid as defined in claim 3 wherein a radial step is provided in each female connector and a radial flange is provided on each male connector, said flange and step adapted to bear against each other and prevent separation of the connectors.

5. A modular reinforcing grid as defined in claim 4 wherein each post is provided with a countersunk upper surface.

6. A modular reinforcing structure for use in setting tile comprising:

(a) at least one series of primary plastic strips arranged in spaced relation to form a grid defining geometric shaped openings, (b) mounting posts having axial openings forming junctions between adjacent strips to provide uniform depth to the grid the upper egdes of said primary plastic strips lying in the same plane as the upper surface of said mounting posts and the lower edges of said primary plastic strips being at the approximate midlength of said mounting posts (c) secondary strips interconnecting said primary strips within said geometric openings said secondary strips having upper edges that lie in a plane below the upper edges of said primary strips, and (d) connectors along the edges of each grid module, some of said connectors consisting of mounting posts with enlarged opening extending axially thereof.

7. A modular reinforcing grid as defined in claim 6 wherein others of said connectors are made up of tubular plugs adapted to be received within the enlarged openings of the said mounting posts.

8. A modular reinforcing grid as defined in claim 7 wherein a radial step is provided within each enlarged opening and a radial flange is provided on the periphery of each tubular plug, said flange being adapted to be engaged by said step to prevent withdrawing of the plug from the enlarged opening.

* * * * *